United States Patent [19]

d'Alayer de Costemore d'Arc

[11] Patent Number: 4,480,387

[45] Date of Patent: Nov. 6, 1984

[54] CLEANING DEVICE FOR RAZORS

[75] Inventor: Stephane M. d'Alayer de Costemore d'Arc, Ways, Belgium

[73] Assignee: Staar S. A., Belgium

[21] Appl. No.: 341,783

[22] Filed: Jan. 22, 1982

Related U.S. Application Data

[63] Continuation-in-part of Ser. No. 310,988, Oct. 13, 1981, abandoned.

[30] Foreign Application Priority Data

Oct. 24, 1980 [BE] Belgium ..... 885,872

[51] Int. Cl.[3] ..... B26B 19/44

[52] U.S. Cl. ..... 30/41; 30/90; 134/183; 222/148

[58] Field of Search ..... 222/148-151; 30/41.5, 41, 40, 90; 134/182, 183, 198, 200, 117

[56] References Cited

U.S. PATENT DOCUMENTS

| | | | |
|---|---|---|---|
| 1,598,811 | 4/1926 | Ferrin | 30/41.5 |
| 2,611,631 | 9/1952 | Benson | 134/183 |
| 2,964,047 | 12/1960 | Jackson et al. | 134/182 |
| 3,172,202 | 3/1965 | Sooter | 30/90 |
| 3,314,659 | 4/1967 | Ranson | 134/183 |
| 3,754,326 | 8/1973 | Glaberson | 30/90 |
| 4,027,387 | 6/1977 | Kellis | 134/182 |
| 4,228,586 | 10/1980 | Thierry | 30/41 |
| 4,228,587 | 10/1980 | Bennett | 30/41 |
| 4,339,876 | 7/1982 | Davis | 30/90 |

FOREIGN PATENT DOCUMENTS 983133 6/1951 France .

*Primary Examiner*—Joseph J. Rolla
*Assistant Examiner*—Kenneth Noland
*Attorney, Agent, or Firm*—Leydig, Voit, Osann, Mayer and Holt, Ltd.

[57] ABSTRACT

A cleaning device for razor cartridges, particularly of the "twin blade" type, having a casing with a socket into which a cartridge may be snapped in place, the casing having an inlet for water from a faucet and channels directing the flow of water and producing jets, the cartridge being held such that the jets are aimed directly at the space between the blades so that water flows between and around the blades and through passages in the cartridge to flush accumulated soap and shaving residue; the cleaning device is disclosed in the cap of a shaving foam dispenser and in the case in which the razors are put on sale.

13 Claims, 9 Drawing Figures

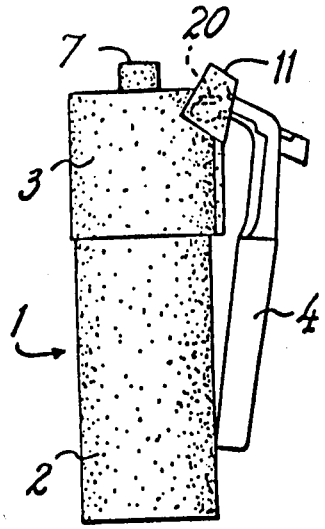
FIG. 1
FIG. 2
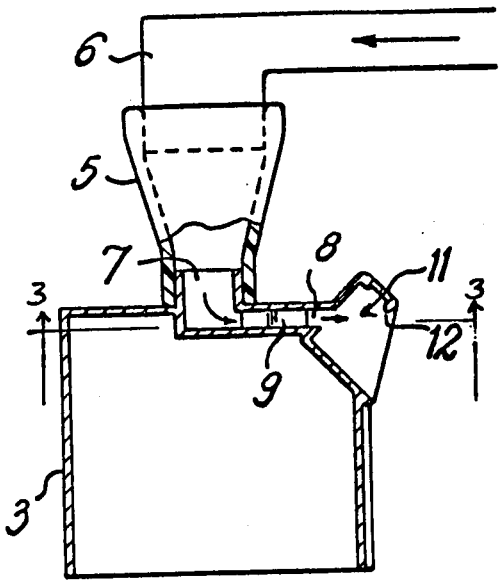
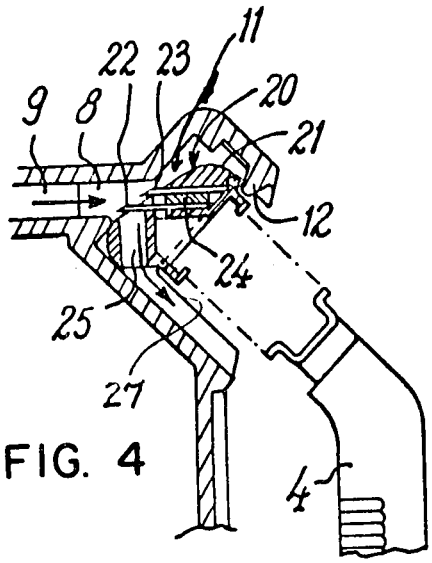
FIG. 4
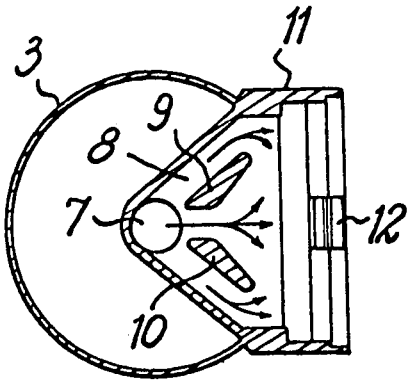
FIG. 3

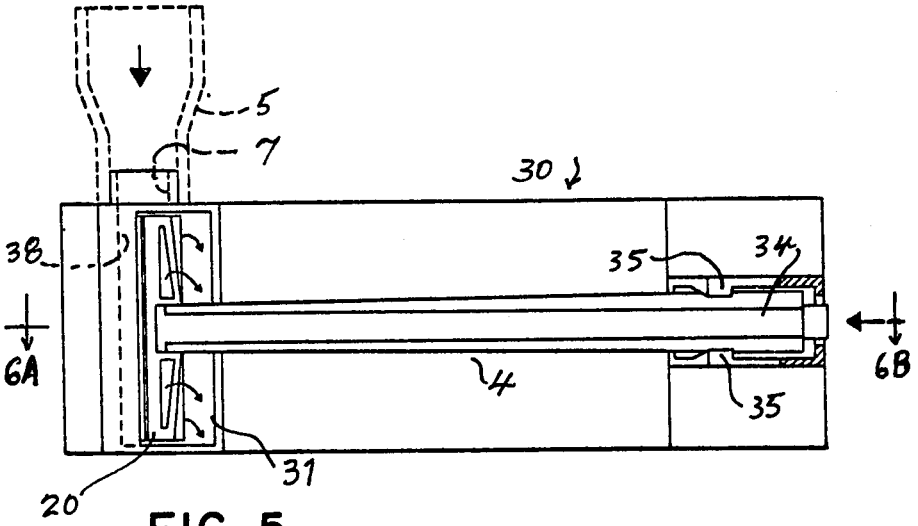
FIG. 5
FIG. 6B
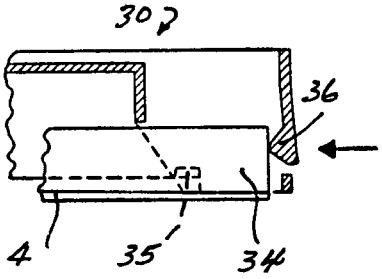
FIG. 6A
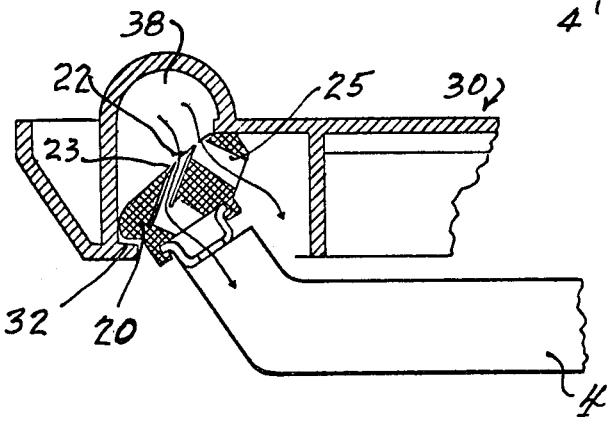

CLEANING DEVICE FOR RAZORS

This is a continuation-in-part application of U.S. application Ser. No. 310,988, filed Oct. 13, 1981 entitled "CLEANING DEVICE FOR RAZORS" now abandoned.

The present invention relates to cleaning devices for safety razors and, more particularly, to cleaning devices for cartridges of the "twin blade" type.

In razors of this type the hairs cut off by the blades, and the foam used for shaving, accumulate between the twin razor blades and between the blades and body of the cartridge, thus very considerably reducing the efficiency of this type of mounting. It should also be noted that so-called "thick" foams very quickly obstruct the space formed between the twin blades and this occurs even before the user finishes shaving. Rinsing these "twin blade" cartridges under the tap is effective only to a very limited extent.

It has already been proposed to place between these blades a flexible plastic strip which can be operated by the user to push out particles which have accumulated between the two blades, but this solution is not very satisfactory because the very presence of this strip of plastic prevents as rigid a guiding and fastening of the twin razor blades. This has the consequence that the blades, when so mounted, are more flexible; as a result, their effectiveness is reduced, the risk of cutting oneself is increased and since, in addition, the cleaning is only partly effective, this solution has a very limited success. Moreover, a cleaning system of this kind must be incorporated in every "twin blade" cartridge, thus increasing the complexity of the assembly and its cost.

The present invention seeks to overcome these disadvantages and to provide a simple and effective cleaning device for razor cartridges.

A second object of the invention is to propose a cleaning device which requires no modification of the mounting for the blades of the "twin blade" cartridges so that the guiding and fastening of the razor blades are not adversely affected.

A third aim of the invention is to propose a cleaning device which is independent of the cartridges and razors, so that a large number of cartridges can be cleaned using the same device.

A fourth aim of the invention is to propose a very low cost device so that it might be made available economically to assist users of "twin blade" razor cartridges.

How these and other objects are attained will be seen from the following description of the preferred embodiments, taken in conjunction with the accompanying drawings, in which:

FIG. 1 shows a conventional shaving-foam dispenser provided with a cap containing a cleaning device embodying the invention;

FIG. 2 is a vertical sectional view of the cap shown in FIG. 1 illustrating the construction of the cleaning device;

FIG. 3 is a sectional view of the cleaning device taken substantially in the plane of lines 3—3 in FIG. 2;

FIG. 4 is an enlarged fragmentary sectional view showing the cleaning device of FIG. 2 with a cartridge in place;

FIG. 5 illustrates an alternative cleaning device embodying the invention;

FIGS. 6A and 6B are enlarged fragmentary sectional views in the plane of lines 6—6 of FIG. 5;

Figure 7:
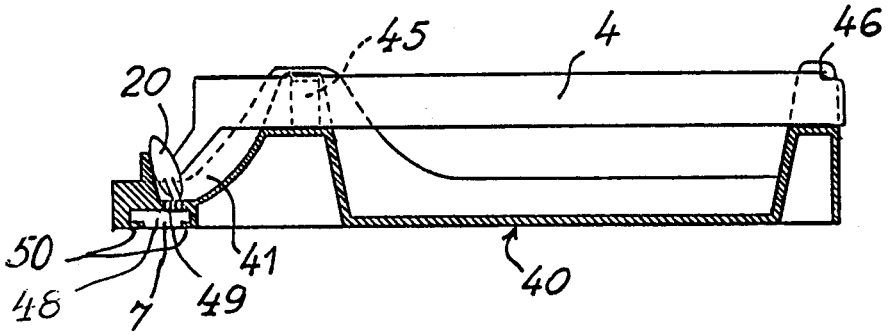
FIG. 7 is a sectional view taken in the plane of lines 7—7 of FIG. 7A, illustrating another alternative cleaning device embodying the invention.

Referring to FIG. 1, there is shown a conventional shaving-foam dispenser 1 comprising a container 2 for the shaving foam having a cap 3 in which, according to the invention, a device is incorporated for cleaning the "twin blade" cartridge fixed to the end of the handle of a razor 4.

In this preferred embodiment of the invention, means are provided in the cleaning device with the aid of which the rigid guide obstructing the space between the blades of the cartridge serves especially as an impact surface for jets of water, which are thrown back in counter-current. The powerful jets then flow around the blades so as to clean them because the water and residue are evacuated through the openings existing between the blades and the body of the cartridge.

Referring to FIGS. 2 and 4, the cleaning device comprises a casing formed as an integral part of the container cap 3 having a socket 11 to hold the cartridge, which may be inserted and locked in place in the socket for cleaning, as shown in FIG. 4. For conveying water from a supply, the cleaning device comprises a water inlet 7 provided with a flexible connector 5, which is preferably slightly conical so that it can easily be fastened to a faucet spout 6.

To channel the flow and produce powerful jets for flushing residue from around the blades, the inlet 7 leads into a cavity 8 which widens out in the direction of the socket 11 for the "twin blade" cartridge 20, the cavity having baffles 9, 10 (FIG. 3) for distributing the water across the entire width of the head of the "twin blade" cartridge and producing and aiming the jets.

The cartridge 20 is held in its ideal cleaning position (FIG. 4) in the socket 11 by projections on the casing providing a latch 12. By applying very slight force to the handle 4 of the razor, the cartridge 20 is snapped in place in its cleaning position with its upper edge fitting behind the projections providing the latch 12 and its lower edge resting against the flat bottom wall of the socket 11 and extracted from that position because of the slight flexibility of the casing 11, which allows the cartridge to be removed by swinging the handle up.

A "twin blade" cartridge 20 is shown in FIG. 4, comprising a plastic head 21 carrying both razor blades 22, 23 and a rigid metal guide 24 which to a large extent obstructs the space formed between the two blades and which is intended to serve in combination with plastic elements of the head for guiding and fastening the "twin blades" and for maintaining an ideal fixed spacing between the twin blades.

As can be understood, this metal guide 24, which is utilized for the rigid support and fastening of the "twin blades" of the cartridge, is partly responsible for the clogging of the space between the "twin blades" because it blocks flow of rinsing water.

However, with the present invention, very powerful jets are produced from normal faucet flow and directed at the cavities between and around the blades containing soap and hair residue. To this end, as can clearly be seen in FIG. 4, when the faucet 6 is turned on, the water is channeled through the connector 5 and the inlet 7 and the jets of water are then directed through the cavity 8 and distributed by the baffles 9, 10 towards the socket 11.

An important characteristic is that the space formed between the blades by the guide 24 is positioned exactly opposite the horizontal cavity 8 so that the jets of water are projected into it and this space is thus very effectively cleaned.

Part of the water from these jets escapes the cavities between the guide and the blades because of the spaces between the head of the cartridge and the walls of the socket 11, which is not entirely watertight, but the greater part of the water thrown back in counter-current by the guide 24 mingles with the jets of water passing either side of the blades 22, 23. These jets are then driven back by the bottom of the socket 11 so that the means including the socket 11 holding the cartridge 21 in position substantially confines the water flow so that it escapes through the passages 25 extending from beneath the blades 22, 23 in the body 21 of the cartridge. These passages 25 are provided in conventional "twin blade" cartridges.

This cleaning device construction is particularly advantageous because, since the jets of water have to flow around the razor blades, they effect complete cleaning of the latter.

As previously explained, the latch 12 serves to hold the cartridge in its ideal cleaning position and in particular enables the user to disconnect it from the razor handle (FIG. 4). The handle may then be fastened to a cartridge locked in the socket 11, after the cartridge has been cleaned.

In cases where the cartridge is fastened on the razor by sliding one of these parts in relation to the other, a cutout 27 is provided in one of the side walls of the socket 11 (FIG. 4) in order to facilitate this sliding movement.

One of the features of the invention is that a razor cleaning device may be incorporated, as shown in FIG. 1, as part of a shaving foam dispenser and also serves for holding a razor without requiring a separate case.

However, according to the invention, a cleaning device may be provided in the case in which the razors (handle with cartridge and/or spare cartridges) are put on sale and are stored in the bathroom cabinet by the user.

FIGS. 5, 6A and 6B show such a support or case 30 wherein the cartridge 20 and razor handle 4 are held in the case by a socket 31 for the cartridge, latch means 32 engaging the head of the cartridge 20, and two resilient finger-like projections 35, which extend over and hold the end 34 of the handle in the case. In order to hold the cartridge securely in the bottom of the socket 31, a resilient stop 36 is provided which is integral with the body of the case 30 and which acts on the bottom face of the handle 4.

In this illustrated embodiment of the invention, the cleaning device has an inlet 7 adapted to be supplied from a faucet via a flexible connector 5. In this instance, the inlet 7 is located laterally in relation to the socket 31 for the cartridge and leads into a channel 38 such that the force of water channeled from the inlet is directed against the entire width of the cartridge face and against the edges of the blades 22, 23 of the cartridge 20. Thus, a very powerful force of water is produced directed against the blades which flows through the openings 25 in the cartridge 20 to remove the accumulated residue and clean the blades.

Figure 7A:
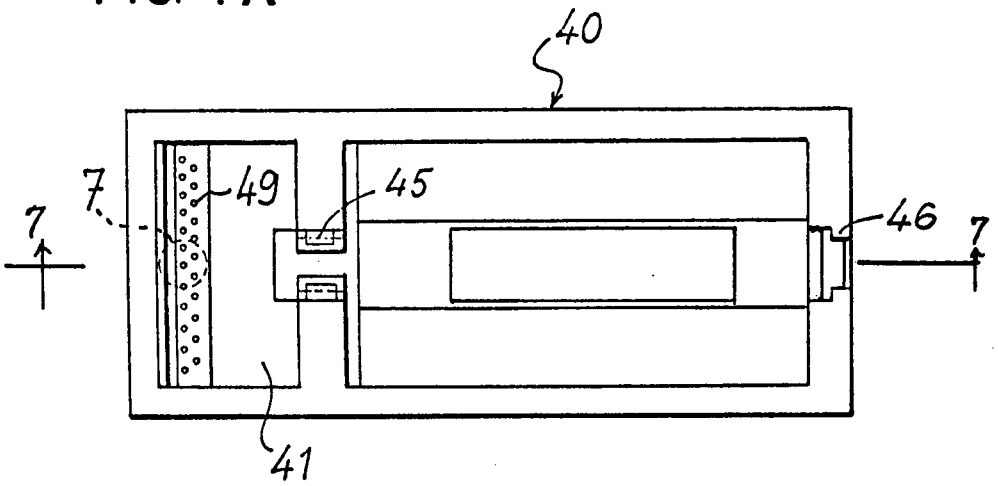
FIG. 7A is a plan view of the device shown in FIG. 7 with the razor removed.

FIGS. 7 and 7A show another support or case 40 embodying a cleaning device for a razor according to the invention. In this instance, the cartridge 20 and razor handle 4 are held by two resilient finger-like projections 45 which enter recesses in the razor handle 4. In order to hold the cartridge securely in the socket 41, the support 40 is provided with two projections 46 which act on the end of the razor handle so as to refrain it from moving.

In this illustrated embodiment, the cleaning device has an inlet 7 located underneath the socket 41 and leading into the midpoint of a channel 48 such that the force of water channeled from the inlet is directed against the entire width of the cartridge. The periphery 50 of the inlet 7 is preferably made of soft material, such as rubber, so that no flexible connector is required and the user simply presses the inlet 7 against the faucet spout to establish connection. Such a construction has the advantage that it fits with any type of faucet spout and therefore it can be used worldwide.

To clean the cartridge and the "twin blade" assembly, the water is channeled through rows of apertures 49. Said apertures create powerful jets of water and turbulence which enable the "twin blade" assembly to be cleaned much more efficiently.

This is particularly advantageous when the "twin blade" assembly is of the type wherein no apertures exist between both blades 22, 23, i.e., when the guide 24 (FIG. 4) obstructs all that space.

The cleaning device of this invention is useful for cleaning not only "twin blade" cartridges having spaces formed between the blades but also "twin blade" cartridges in which the blades are abutting and single blade cartridges in which spaces around the blades tend to accumulate soap and shaving residue. However, the invention finds its greatest utility for cleaning, within a few seconds, heavily clogged cartridges of the "twin blade" type having spaced blades where simple rinsing under the tap has little or no effect and, on completion of the rinsing, the user can easily withdraw his razor and the cartridge which was fixed in the cleaning device by applying very slight force to the handle of the razor.

I claim:

1. A cleaning device for razor cartridges having an exterior face with at least one blade projecting therefrom and water passages extending inwardly from said exterior face through said cartridge past said blade comprising:

a casing having a socket into which a cartridge may be inserted to a fixed position with the outer edges of said cartridge adjacent the walls of said socket and with said exterior face opposite a bottom portion of said socket;

an inlet in said casing for water;

channel means for directing the flow of water from said inlet into said bottom portion of said socket;

means for locking the cartridge in said fixed position in said socket such that water channeled from said inlet is directed into said socket by said channel means and toward said cartridge against the edge of a blade of said cartridge and is substantially confined to escape from the socket by passing inwardly through said passages in the cartridge to flush soap and shaving residue accumulated in and around said blade.

2. A cleaning device for razor cartridges of the "twin blade" type having an exterior face with twin blades projecting therefrom and water pasages extending inwardly from said exterior face through said cartridge past the edges of said blades comprising:

a casing having a socket into which a cartridge may be inserted to a fixed position with the outer edges of said cartridge adjacent the walls of said socket and with said exterior face opposite a bottom portion of said socket;

an inlet in said casing for water;

channel means for directing the flow of water from said inlet into the bottom portion of said socket;

means for locking the cartridge in position in said socket such that water channeled from the inlet is directed into the bottom portion of said socket and against the edges of both blades and any space formed between said blades and is substantially confined to escape from the socket by passing inwardly through said passages in the cartridge to flush soap and shaving residue accumulated in and around the blades.

3. A cleaning device according to claim 1 for a "twin blade" cartridge having a rigid guide between the blades wherein said channel means directs jets of water against the edges of said blades and against said guide, said guide serving as an impact surface for some of the jets of water, which are thrown back in counter-current and pass around the blades to escape through said passages.

4. A cleaning device according to claim 1 or 2 wherein said channel means includes a cavity into which the water inlet leads and which widens out in the direction of the socket for the cartridge, any space formed between two blades of a cartridge being positioned exactly opposite the cavity.

5. A cleaning device according to claim 4 wherein said channel means for directing the flow of water includes baffles for distribution and for producing jets of water.

6. A cleaning device according to claim 1 or 2 wherein said channel means for directing the flow of water includes baffles for distribution and for producing jets of water.

7. A cleaning device according to claim 1 or 2 wherein said means for holding the cartridge in cleaning position in said socket includes means for locking the cartridge in said socket, allowing the razor handle to be disconnected from the cartridge and, conversely, allowing the razor handle to be fastened to a cartridge held in said socket.

8. A cleaning device according to claim 1 wherein said means for holding the cartridge in cleaning position in said socket includes means for locking the cartridge in said socket, allowing the razor handle to be disconnected from the cartridge and, conversely, allowing a razor handle to be fastened to a cartridge held in said socket.

9. A cleaning device according to claim 1 or 2 provided in the cap of a shaving foam container.

10. A cleaning device according to claim 1 or 2 provided in the storage case of a razor.

11. A cleaning device according to claim 10 wherein said means for holding the cartridge in cleaning position includes retaining means acting on the handle of the razor.

12. A cleaning device according to claim 11 wherein said retaining means acting on the handle of the razor comprises a resilient stop integral with the body of the case and which acts on the bottom face of the handle in order to hold the cartridge securely in the bottom of the socket.

13. A combined shaving foam dispenser cap and cleaning device for razor cartridges of the "twin blade" type having spaced blades and water passages adjacent the blades, said cap having a socket into which a cartridge may be inserted to a position closely surrounded by said socket, said cap having an inlet for water from a faucet and channels directing the flow of water and producing jets, means included in said socket for positioning said cartridge such that the jets are aimed directly at the space between the blades so that water flows between and around the blades and escapes substantially entirely by passing inwardly through said passages in the cartridge to flush accumulated soap and shaving residue.

* * * * *